US005775572A

United States Patent [19]

Oliff

[11] Patent Number: 5,775,572

[45] Date of Patent: Jul. 7, 1998

[54] CARTON WITH CENTER PARTITION

[75] Inventor: James R. Oliff, Douglasville, Ga.

[73] Assignee: The Mead Corporation, Dayton, Ohio

[21] Appl. No.: 869,389

[22] Filed: Jun. 5, 1997

[51] Int. Cl.[6] ..... B65D 5/4805

[52] U.S. Cl. ..... 229/120.03; 229/120.14; 229/131.1; 229/244

[58] Field of Search ..... 229/120.03, 120.04, 229/120.14, 131.1, 243, 244; 206/141, 427

[56] References Cited

U.S. PATENT DOCUMENTS

| | | | |
|---|---|---|---|
| 914,809 | 3/1909 | Davis | 229/120.14 |
| 2,076,844 | 4/1937 | Holmes | 229/120.14 |
| 2,297,982 | 10/1942 | Potts | 229/120.03 |
| 3,104,046 | 9/1963 | Arneson | 229/120.14 |
| 3,760,978 | 9/1973 | Stone | 229/120.14 |
| 3,819,043 | 6/1974 | Harrison | 229/131.1 |
| 3,974,911 | 8/1976 | Graser | 206/141 |
| 4,043,095 | 8/1977 | Graser | 53/448 |
| 4,155,449 | 5/1979 | Bryne | 206/427 |
| 4,588,084 | 5/1986 | Holley, Jr. | 206/427 |
| 4,715,493 | 12/1987 | Dreyfus | 206/200 |
| 4,830,267 | 5/1989 | Wilson | 206/141 |

FOREIGN PATENT DOCUMENTS

| | | |
|---|---|---|
| 1 053 191 | 4/1979 | Canada . |
| WO 86/05463 | 9/1986 | WIPO . |

*Primary Examiner*—Gary E. Elkins
*Attorney, Agent, or Firm*—Michael V. Drew

[57] ABSTRACT

A carton (10) has opposing side walls (22, 24) adjoining top (66, 46) and bottom (14) walls forming the tube portion of the carton (10). Opposing end closures adjoin the end portions of the tube. The top wall (46, 66) of the carton is multiple-ply with the inner-most ply (46) having a drop-down separator panel (48). The separator panel (48) has a configuration and placement which is compatible with an opening feature formed in the outer-most ply (66).

10 Claims, 2 Drawing Sheets

CARTON WITH CENTER PARTITION

FIELD OF THE INVENTION

The present invention relates to a carton for articles, and more particularly to a carton having a drop-down partition for segregating at least portions of groups of the articles.

BACKGROUND OF THE INVENTION

When packaging multiple articles in a carton it is often desirable to provide separation between adjacent articles. When the articles which are packaged are bottles, separation is particularly desirable, and often essential, because separation of bottles helps prevent bottle breakage. If an attempt is made to provide separation between adjacent bottles it is important that the means for separation be applied in a manner that does not slow down the packaging process. Thus, it would be desirable to have a means for providing separation between articles which means may be applied without unduly delaying the packaging process, if at all. Also, because some cartons have other features associated with the carton, such as various types of opening features, it would be beneficial to provide the article separation means in a manner which does not interfere with the operation of other carton elements and features.

SUMMARY OF THE INVENTION

The present invention provides a means for separating adjacent articles in a carton which means is integrally formed with the carton and is compatible with other unrelated carton features. According to a preferred embodiment of the present invention, a carton has opposing side walls adjoining top and bottom walls forming the tube portion of the carton. Opposing end closures adjoin the end portions of the tube. The top wall of the carton is multiple-ply with the inner-most ply having a drop-down separator panel. The separator panel has a configuration and placement which is compatible with an opening feature formed in the outer-most ply.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
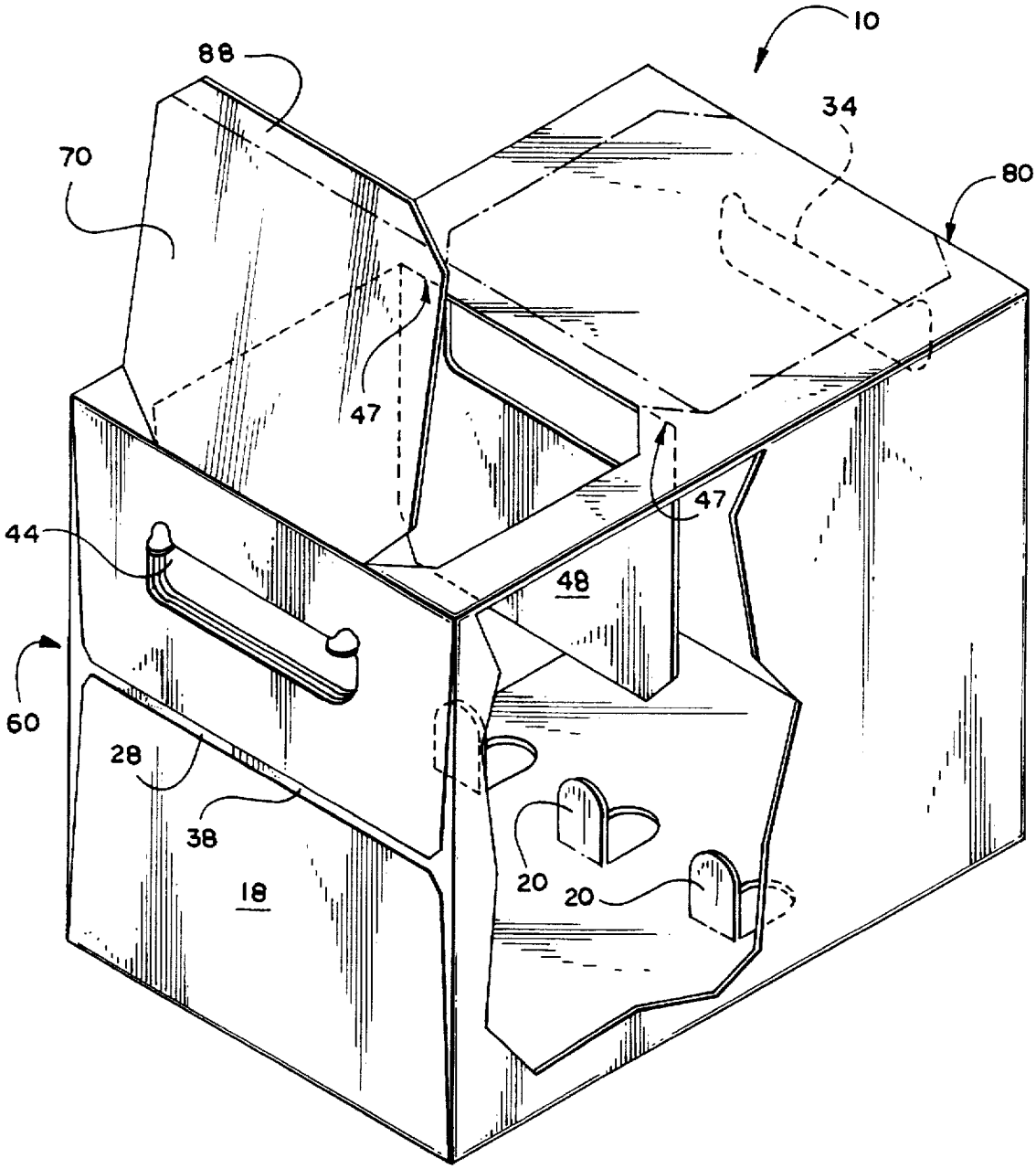
FIG. 1 is a perspective view with cut-away portions of a carton with a drop-down separator panel according to a preferred embodiment of the present invention.

In the drawings the same reference numerals are used to denote like features. As an overview, with reference first to both FIGS. 1 and 2, therein is illustrated a carton 10 with drop-down separator panel 48 and blank 12 according to a preferred embodiment of the invention. The drop-down separator panel 48 of the carton 10 is compatible with other features of the carton 10, including a top-opening feature of the carton and reinforced top and end closure walls.

Figure 2:
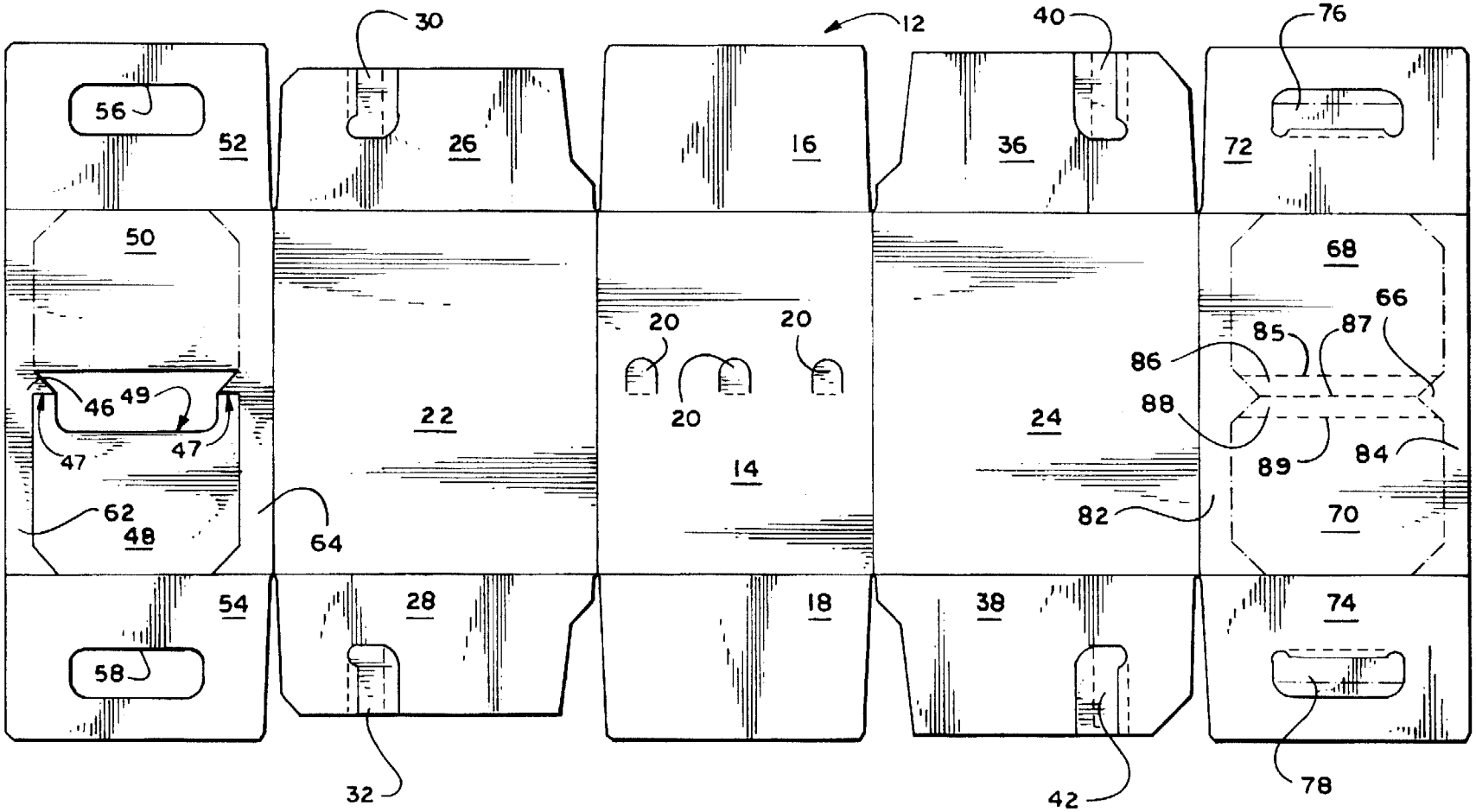
FIG. 2 is a blank suitable for forming the carton of FIG. 1.

The features of the carton 10 and blank 12 from which it may be formed will be initially described with simultaneous reference to FIGS. 1 and 2. The blank 12 illustrated and described is a simple preferred means of forming the carton 10.

The carton 10 is a generally tubular structure with end closures. The bottom panel 14 has first and second bottom end panels 16, 18 foldably connected to opposed end edges of the bottom panel 14. The bottom panel 14 contains at least one bottom separation tab 20, and preferably several.

First and second side panels 22, 24 are connected to opposed side edges of the bottom panel 14. Each side panel 22 and 24 has first and second side end panels 26, 28 and 36, 38, respectively, hingedly connected to opposed end edges of the respectively side panels 22 and 24. Each side end panel 26, 28 and 36, 38 has a slot-type opening with a hand-hole tab 30, 32 and 40, 42 hingedly connected to and generally covering the opening.

The multiple-ply top wall of the carton 10 may be formed from as many plies of material as desired, however, in the preferred embodiment illustrated two layers of material are used. An inner-most top panel 46 has a top separator panel 48 hingedly connected thereto. Fold lines 47 form a part of the hinge structure. The inner-most top panel 46 also has a detachably attached inner access (or opening) panel 50 integrally formed therewith.

In the preferred embodiment illustrated, the separator panel 48 does not extend all the way to the side edges of the inner-most top panel 46 but instead defines an opening which leaves peripheral strips of material 62, 64. The chamfered or otherwise truncated corners of the separator panel 48 and the openings defined and associated therewith provide surfaces and edges which are less likely to adversely tear when the opening features, and other features, of the carton 10 are utilized. The inner opening/access panel 50 does not extend all the way to the side edges of the inner-most top panel 46 but instead also defines an opening which when removed leaves the extended peripheral strips 62, 64. Also, as with the structure of the separator panel 48, the inner access panel 50 in the preferred embodiment illustrated has truncated corners to enhance structure integrity.

An outer-most top panel 66 has a pair of adjacent pivotable outer access panels 68, 70 integrally formed with the outer-most top panel. A pair of outer top end panels 72, 74 are hingedly connected to opposed end edges of the outer-most top panel 66. Each outer top end panel 72, 74 has a hand-hole opening 76 and 78, respectively.

The outer access panels 68, 70 and inner access panel 50 and the separator panel 48 have configurations corresponding to one another. And, likewise, the openings defined by the outer access panels 68, 70 and the openings defined by the inner access panel 50 and the separator panel 48 have configurations corresponding to one another. Also in a manner similar to the structure associated with the inner-most top panel, the outer access panels 68, 70 do not extend all the way to the side edges of the outer-most top panel 66 but instead define an opening which leaves peripheral strips of material 82, 84. Also in like manner, the chamfered or otherwise truncated corners of the outer access panels 68, 70 and the openings defined and associated therewith provide surfaces which are less likely to adversely tear when the features of the carton 10 are utilized.

Adjacent starter flaps 86, 88 serve several purposes. These flaps 86, 88 share a weakened severance line 87 which allows them to be separated from one another as a hand is inserted to separate the two and open the top of the carton 10. When turned under (by folding along fold lines 85, 89, respectively) the starter flaps 86, 88 provide a cushion for grasping the access panels 68, 70.

Assembly of the carton 10 from the blank 12 is accomplished by folding the bottom separation tabs 20 upward and side panels 22, 24 upward at right angles to bottom panel 14. The inner-most top panel 46 is folded so that it is parallel to and overlies the bottom panel 14. The separator panel 48 drops down to a generally vertical position due to gravity and the fold lines 47 which help form the hinge structure. The outer-most top panel 66 is folded over the inner-most top panel 46 and adhered thereto. At this point a tubular structure with open ends is formed. Articles, such as bottles, may then be inserted from each open end of the carton 10. Lastly, the various end panels 16, 18, 26, 28, 36, 38, 52, 54, 76, 74 are overlapped and secured to form respective end closures. The order in which the various end panels 16, 18, 26, 28, 36, 38, 52, 54, 76, 74 are overlapped for closure may be modified without adversely affecting the structural integrity of the carton. Different aesthetic appearances can be achieved by modifying the order of overlapping. In the erected carton 10, the openings in the various side end panels 26, 28, 36, 38 and top end panels 52, 54, 72, 74 and bottom end align to form hand-hole apertures 34, 44.

The bottom separation tabs 20 help provide separation between the groups of articles/bottles on opposite sides of the tabs 20. Each bottom separation tab 20 is configured to provide adequate separation for the heels of packaged articles (for example, bottles). However, because of the configuration and size of the bottom separation tabs 20, when the tabs 20 are folded out of the plane of the bottom wall 14 the integrity and strength of the bottom wall 14 and carton 10 are not adversely affected.

The drop-down separator panel 48 provides separation between articles/bottles at least at the upper regions of the articles. For example, at the shoulder regions of bottles. In the preferred embodiment illustrated the separator panel 48 is shown to extend only part of the distance toward the bottom wall of the carton 10, however, the dimensions of the carton 10 may also be such that the separator panel extends more closely or completely to the bottom wall. The separator panel 48 is shown attached to the inner-most top panel 46 by a weakened score line 47 but may utilize any other carton structural element which encourages the separator panel to easily drop down into place in the erected carton.

The carton 10 of the preferred embodiment has reinforcement and opening features with which the drop-down separator panel 48 is compatible. The end walls 60, 80 (shown in FIG. 2, but wherein end wall 80 is not readily visible) are multiple-ply, composite walls formed by the various end panels 16, 18, 26, 28, 36, 38, 52, 54, 72, 74 of the blank 12 previously discussed. The innermost top panel 46 and outer top panel 66 contribute to reinforcement of the side walls 60, 80 by means of the various top end panels 52, 54, 72, 74 described. The inner 46 and outer 66 top panels contribute directly to reinforcement of the top wall by providing two overlapping panels. The rigidity of the composite top wall is maintained even when the access panels 50, 68, 70 are partially separated from and pivoted outwardly with respect to the inner 46 and outer top 66 panels because of the strips 62, 64, 82, 84 discussed above. As previously mentioned, the drop-down separator panel 48 has a configuration which corresponds to and is positioned in register with the access panel 70 in the outer top panel 66. Thus, the opening provided when the separator panel 48 drops into place is compatible with the opening provided when the access/opening panel 70 in the top wall is lifted. The separator panel 48 is attached to the inner top panel 46 by hinges in such a manner that it is securely attached yet freely drops into place. The rear cut-out (or aperture) 49 of the separator panel 48, which in the preferred embodiment has a generally U-shaped configuration corresponding to and compatible with the configuration of the adjacent facing hand-hole flaps 86, 88 in the carton 10, generally enables the carton to be opened without interference and, further, enables noninterfering manipulation of the access panels 68, 70 and starter panels 86, 88 in the outer top panel 66.

An adhesive may be strategically applied by means known in the art to bond the opening/access panels 50, 68 to one another and the strips 62, 82 and 64, 84 to one another in the inner 46 and outer 66 top panels. The bonded area along the edges and corners strengthens the carton where needed to keep the carton intact when the bottles are full and afterwards when the opening panels are lifted and empty bottles are loaded through the top. Because multiple plies of material are used, thin stock can be used. The bevelled corners on the various opening flaps 50, 68, 70 and drop-down partition 48 help inhibit undesirable tearing when these features are separated from the panels with which they are integrally formed. Chamfering the corners of the panels eliminates sharp corners that could promote tearing and eventual destruction of the structural integrity of the carton.

While the invention has been described with particular reference to the preferred embodiments, it is evident that certain aspects of the invention are not limited to the particular details of the examples illustrated, and it is therefore contemplated that other modifications and applications will occur to those skilled in the art. For example, the carton can be assembled from the blank using a different sequence of steps than described, and, while a unitary blank is preferred, a multi-piece blank can be used. It is accordingly intended that the claims shall cover all such modifications and applications as do not depart from the true spirit and scope of the invention.

What is claimed is:

1. A carton (10) comprising:

a tubular structure having a multiple-ply top wall wherein an outer-most ply (66) thereof has at least one removeable access panel (68, 70) and an inner-most ply (46) adjacent said outer-most ply (66) has a drop-down panel member (48) hingedly attached to said inner-most ply (46) and integrally formed with said inner-most ply (46), said drop-down panel member (48) having a configuration corresponding to said at least one removeable access panel (68, 70), wherein said at least one removeable access panel ( 68, 70) and said drop-down panel member (48) lie adjacent one another when the carton (10) is in a collapsed condition and said drop-down panel member (48) pivots to a substantially vertically position when the carton (10) is placed in an erected condition wherein a perimeter of said top wall remains multiple-ply.

2. The carton (10) of claim 1, wherein a hand-hole flap (86, 88) adjoins said at least one removeable access panel (68, 70) and an aperture (49) is formed in said inner-most ply (46) adjacent said hand-hole flap (86, 88).

3. The carton (10) of claim 2, wherein said aperture (49) has a second configuration corresponding to a third configuration of said hand-hole flap (86, 88).

4. The carton (10) of claim 1, wherein said drop-down panel member (48) is hingedly attached to said inner-most ply (46) by means for facilitating pivoting of said drop-down panel member (48) with respect to said inner-most ply (46).

5. The carton (10) of claim 4, said means for facilitating pivoting of said drop-down panel member (48) with respect to said inner-most ply (46) comprising attachment of said drop-down panel member (48) to said inner-most ply (46) along weakened score lines (47).

6. The blank (12) of claim 4, said means for facilitating pivoting of said drop-down panel member (48) with respect to said inner-most ply (46) comprising attachment of said drop-down panel member (48) to said inner-most ply (46) along weakened score lines (47).

7. A blank (12) for forming a carton (10), the blank (12) comprising:

a series of foldably-adjoining panels including a pair of side wall panels (22, 24), a bottom wall panel (14), and at least a pair of overlappable top wall panels including an outer-most top panel (66) and an inner-most top panel (46) wherein said series of foldably-adjoining panels may be formed into a tubular structure with said at least a pair of overlappable top wall panels (46, 66) forming a multiple-ply top wall of the carton (10), and wherein said outer-most ply (66) has at least one removeable access panel (68, 70) and said inner-most ply (46) adjacent said outer-most ply (66) has a drop-down panel member (48) hingedly attached to said inner-most ply (46) and integrally formed with said inner-most ply (46), said drop-down panel member (48) having a configuration corresponding to said at least one removeable access panel (68, 70), and wherein said at least one removeable access panel ( 68, 70) and said drop-down panel member (48) lie adjacent one another when the carton (10) is formed and is in a collapsed condition and said drop-down panel member (48) pivots to a substantially vertically position when the carton (10) is placed in an erected condition wherein a perimeter of said top wall remains multiple-ply.

8. The blank (12) of claim 7, wherein a hand-hole flap (86, 88) adjoins said at least one removeable access panel (68, 70) and an aperture (49) is formed in said inner-most ply (46) such that when the carton (10) is formed said aperture (49) lies adjacent said hand-hole flap (86, 88).

9. The blank (12) of claim 8, wherein said aperture (49) has a second configuration corresponding to a third configuration of said hand-hole flap (86, 88).

10. The blank (12) of claim 7, wherein said drop-down panel member (48) is hingedly attached to said inner-most (46) by means for facilitating pivoting of said drop-down panel member (48) with respect to said inner-most ply (46) when the carton (10) is erected from the blank (12).

* * * * *